United States Patent [19]

Tomlinson

[11] 4,273,223

[45] Jun. 16, 1981

[54] PROTECTIVE INSERT FOR USE WITH SOFT-SIDED LUGGAGE

[76] Inventor: Lenore E. Tomlinson, 236 SE. 32nd Ave., Portland, Oreg. 97214

[21] Appl. No.: 78,561

[22] Filed: Sep. 24, 1979

[51] Int. Cl.[3] ..... A45C 5/12
[52] U.S. Cl. ..... 190/41 C
[58] Field of Search ..... 190/41 B, 41 C, 49, 190/51, 52

[56] References Cited

U.S. PATENT DOCUMENTS

| | | | |
|---|---|---|---|
| 1,806,246 | 5/1931 | Feldman | 190/51 |
| 2,362,807 | 11/1944 | Dresner | 190/41 B |
| 2,648,412 | 8/1953 | Meyers | 190/41 Z |
| 2,782,890 | 2/1957 | Powell | 190/51 |
| 3,592,314 | 7/1971 | Jacobson | 190/49 |
| 3,861,504 | 1/1975 | McGraw | 190/41 C |

FOREIGN PATENT DOCUMENTS

| | | | |
|---|---|---|---|
| 1632530 | 1/1970 | Fed. Rep. of Germany | 190/49 |

OTHER PUBLICATIONS

W. Bell and Co. Catalog, 1981, pp. 210 & 211, 19th and L Streets, N.W., Washington, D.C.

*Primary Examiner*—Donald F. Norton
*Attorney, Agent, or Firm*—Chernoff & Vilhauer

[57] ABSTRACT

A flexible protective insert for lining a suitcase of soft-sided construction, having elongate flexible ties for securing clothing and the like within the protective insert and having elongate flexible support ties for securing the protective insert within such a suitcase. The insert is preferably constructed of flexible fabric and is light in weight, so that it does not significantly add to the weight of the suitcase nor to the bulk of articles carried within the suitcase. The protective insert protects clothing packed therein from being soiled by articles such as shoes carried within the suitcase, prevents clothing contained therein from moving about within a partially empty suitcase, and thereby being wrinkled, and permits articles contained in the insert to be placed on top of other loosely packed articles within a soft-sided suitcase, giving ready access to either the articles in the insert or to the loosely packed articles.

1 Claim, 3 Drawing Figures

PROTECTIVE INSERT FOR USE WITH SOFT-SIDED LUGGAGE

BACKGROUND OF THE INVENTION

The present invention relates to improvements in luggage, and particularly to an article for use with soft-sided luggage.

Because of the increasing cost of manufacturing conventional hard-sided luggage, many suitcases of recent manufacture comprise a simple frame covered with a pliable material. Conventional hard-sided luggage usually has a large main body to which a hard lid is attached by hinges, and various pockets, dividers, and compartments are usually provided to permit safe storage of clothing, toilet articles, shoes, and the like. Clothing is fastened in place to prevent its becoming wrinkled or soiled by uncontrolled movement within the luggage.

The modern soft-sided luggage, however, comprises a single interior storage cavity for containing all sorts of articles. There is usually no provision for securely holding items such as skirts or trousers, nor for securing clothes hangers within the single large compartment of such luggage. It is left to the user to secure articles within the case. This is often accomplished by packing the luggage so tightly full that the pressure of articles against one another holds them in place within the suitcase.

However, modern soft-sided luggage normally has no hinge-mounted lid, but instead has only a soft side which may be normally closed by means of slide fasteners, but flexibly opens to allow packing and unpacking. There is usually no provision for securely holding items such as skirts or trousers, nor for securing clothes hangers within the single large compartment of such luggage.

The problem of the clothes moving within the suitcase can be overcome if the suitcase is packed by placing folded clothing articles into the bottom of the open suitcase so that they are flat against the side of the suitcase which is permanently closed. Small, irregularly-shaped objects are then placed within the suitcase last, atop the folded clothing and in unfilled corner spaces. In this manner, if the suitcase is packed full enough, the folded clothing is retained in position against the closed side of the suitcase and is protected to some extent from becoming wrinkled. However, the problem of non-clothes items soiling the clothing items remains. Additionally, before the clothing may be removed from such a suitcase the smaller and irregularly-shaped articles must be removed from atop the folded clothing, which is an inconvenience.

What is needed, then, is an inexpensive article of luggage which conveniently protects clothing packed within a soft-sided suitcase, and yet allows easy access to either folded clothing or small and irregularly-shaped articles packed within such a soft-sided suitcase.

SUMMARY OF THE INVENTION

It is a major objective of the present invention to provide an article for protecting clothing within soft-sided luggage of the type described It is another important objective to provide an article for holding clothing and the like in a neatly folded condition within a suitcase of the above-described type even though such a suitcase is not packed tightly.

It is a further objective of the present invention to provide an inexpensive article of luggage which may be used within soft-sided luggage of the above-described type to allow ready access to either folded clothing or loosely packed toilet articles, shoes, and the like.

The present invention comprises a soft protective insert for use within a soft-sided suitcase. The protective insert is preferably a selectively closeable flexible envelope constructed in the same general shape as the luggage within which it is to be used, and of a size which fits conveniently within the storage cavity of the soft-sided luggage. The protective insert of the present invention is preferably rectangular in shape, and preferably includes a closure such as a flap which may be held closed by three slide fasteners. The fasteners preferably extend along three adjacent sides allowing the flap to be opened to present unobstructed access to the interior of the protective insert.

Clothing fasteners, such as flexible ties which may be tied around clothing packed within the protective insert, provide secure retention for folded clothing within the insert to prevent it from moving about and becoming unfolded and wrinkled as the luggage is carried by its handle or otherwise transported. The protective insert of the invention may be fastened to the interior of the soft-sided luggage, for example by the use of support ties which may be secured around portions of the supporting frame of the soft-sided luggage, thereby holding the protective insert in extended condition which promotes retention of folded clothing within the protective insert in a flat condition.

It is an important feature of the protective insert for soft-sided luggage of the present invention that it may be securely closed to protect clothing and other articles stored within the protective insert from being soiled by shoes and the like also packed within a soft-sided suitcase.

It is a further feature of the present invention that it provides a means for securing folded clothing within a partially filled soft-sided suitcase to prevent wrinkling and shifting of the folded clothing within the suitcase.

It is a major advantage of the present invention that it permits folded clothing to be placed within a soft-sided suitcase as a unitary package, allowing access to both folded clothing and the other articles.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
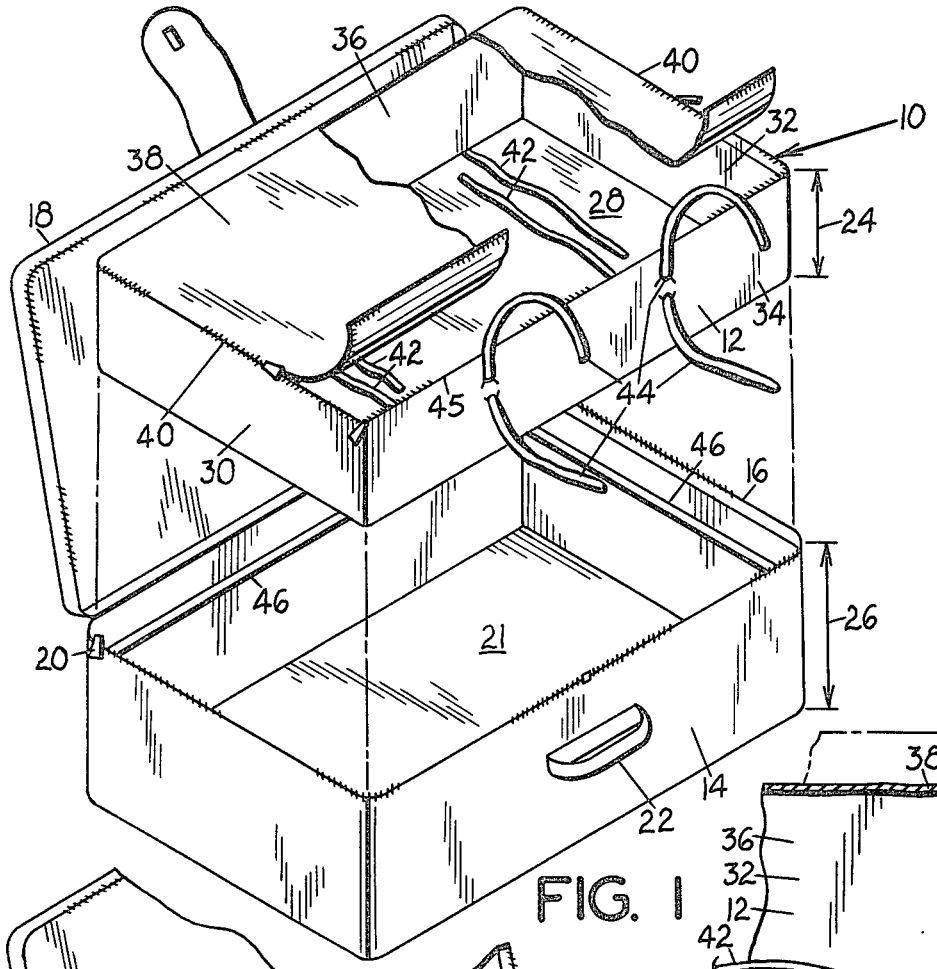
FIG. 1 is a pictorial view of an exemplary protective insert for use within soft-sided luggage, embodying the present invention, along with a soft-sided suitcase within which the protective insert is used.

Referring first to FIG. 1 of the drawings, an exemplary protective insert 10 embodying the present invention may be seen to comprise a generally rectangular envelope 12 which fits within a soft-sided suitcase 14.

The suitcase 14 has a generally rectangular shape and an opening 16 of the suitcase 14 may be closed by a flexible side flap 18 which is normally secured by two slide fasteners 20 which extend up both sides of the suitcase and meet in the center of the front edge of the flap, to retain articles packed within the suitcase 14. The side 21 opposite the flap 18, is permanently closed. The suitcase 14 may be carried by its handle 22, although it is normally packed or unpacked while it is in the position shown in FIG. 1.

The protective insert 10 has a shape generally similar to that of the suitcase 14, although its depth, indicated by the arrow 24, may be less than the depth, indicated by the arrow 26, of the suitcase 14. The protective insert 10 is preferably constructed of light flexible dustproof fabric, and comprises a flat bottom member 28, four vertical sides 30, 32, 34 and 36, and a closeable top flap 38. The top flap 38 is preferably secured by two side slide fasteners 40 and one separating slide fastener on front edge 45. The top flap 38 is fastened flexibly to the top of the fourth side 36, so that it may be folded open, permitting clothing to be placed within the protective insert 10 without interference.

Elongate flexible clothing ties 42 permit folded clothing to be secured within the protective insert 10, holding the clothing flat against the bottom 28 of the protective insert 10.

Figure 3:
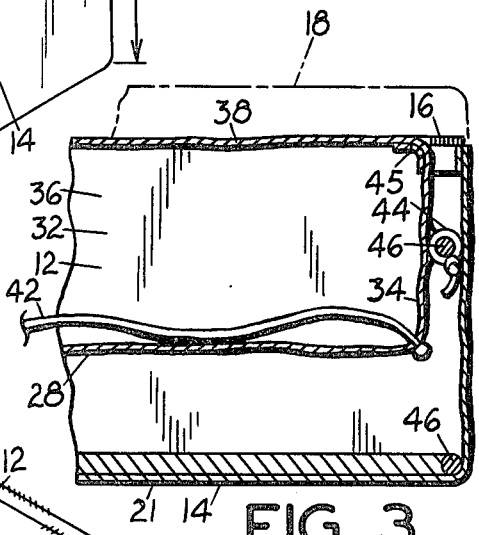
FIG. 3 is a sectional view of a detail of the protective insert and the suitcase shown in FIG. 2, taken along line 3—3.
Figure 2:
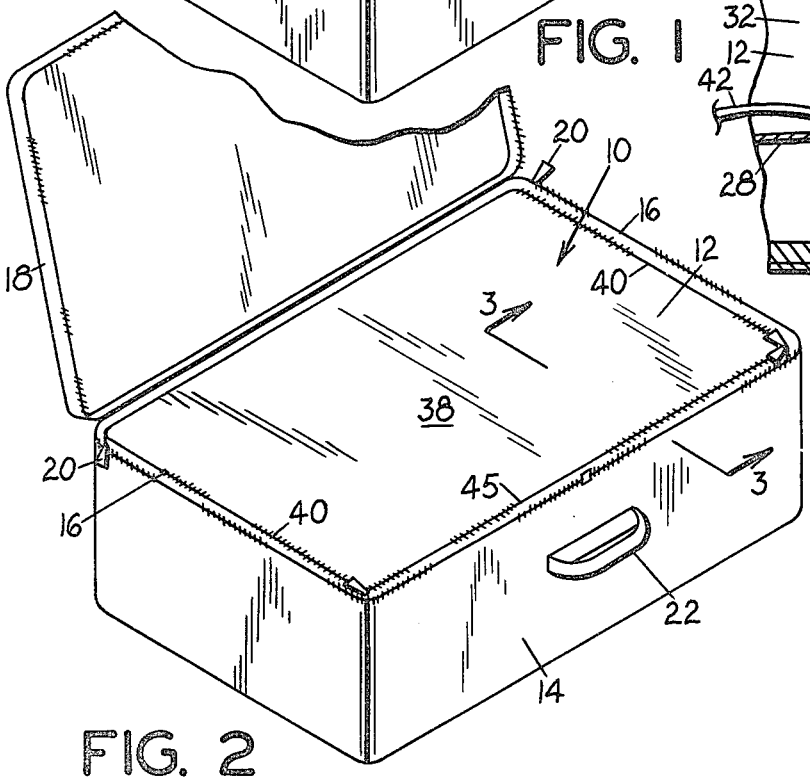
FIG. 2 is a partially cut-away pictorial view of the protective insert of FIG. 1 installed within the soft-sided suitcase insert shown in FIG. 1.

Referring now also to FIGS. 2 and 3, the location of the protective insert 10 when it has been inserted within the suitcase 14 may be seen. The protective insert 10 is preferably of a shallower depth than the suitcase 14, providing space beneath the protective insert for placement of toilet articles, shoes, and the like. The protective insert 10 may be supported and secured to the interior of the soft-sided luggage, as for instance by the use of support ties 44 which are tied to the frame members 46 of the soft-sided suitcase 14. While four of these support ties are shown in the drawing, a greater number of them, or a different type of fastener might be used to support the insert 10 substantially immobile within the soft-sided suitcase 14 with the contents of the insert retained in their flat folded condition.

The protective insert 10 is used preferably by being filled with flat-folded clothing, or similar articles, to be carried within the soft-sided suitcase 14. The folded articles may be secured to the bottom 28 of the protective insert 10 by use of the clothing ties 42, which prevent shifting of the clothing within the protective insert 10. Articles which might soil clothing, or which are not subject to being wrinkled if packed loosely, may be placed against the closed side 21 of the suitcase 14. The insert 10, already having been packed with the desired folded clothing, may then be placed atop the loose articles placed on the closed side 21 within the suitcase 14. The insert 10 may be tied in place by the use of the support ties 44 to prevent shifting and thereby prevent wrinkling of the clothing contained within the protective insert 10.

Because it is a separately closed flexible envelope, the protective insert 10 protects clothing packed therein from being soiled by contact with items such as shoes packed loosely within the soft-sided suitcase 14. Since it is a self-contained unit, the protective insert 10 may be lifted from the suitcase 14, giving access to any of the loose articles within the soft-sided suitcase 14, yet preserving the folded condition of the clothing. Alternatively, the protective insert 10 may be opened without removal from the soft-sided suitcase 14, giving access to the folded articles of clothing without the necessity of first removing loosely packed small articles from atop the folded clothing as would be necessary if the folded articles had been packed in the suitcase in the conventional manner.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A protective insert for separately enclosing articles of clothing and the like within a suitcase, comprising:

(a) a selectively closable flexible envelope having a bottom member, sides attached to said bottom member and a top member attached to one of said sides;

(b) slide fastener closure means for releasably fastening said top member to the remaining ones of said sides to close said enclosure;

(c) support means attached to the exterior of said flexible envelope for attaching said protective insert to the interior of a suitcase to hold said protective insert substantially immobile within said suitcase;

(d) retention means within said protective insert for securing clothing within said protective insert to prevent movement of said clothing therein, said retention means including a plurality of elongate flexible clothing ties attached to the interior of said protective insert; and (e) said envelope being generally rectangular in shape and of a size adapted to fit snugly within said suitcase.

* * * * *